United States Patent [19]

Blasko

[11] Patent Number: 4,944,364

[45] Date of Patent: Jul. 31, 1990

[54] BOOM ELEVATING DEVICE FOR LINE LIFTS

[75] Inventor: Andrew G. Blasko, Riegelsville, Pa.

[73] Assignee: Asplundh Tree Expert Co., Willow Grove, Pa.

[21] Appl. No.: 342,024

[22] Filed: Apr. 24, 1989

[51] Int. Cl.[5] ..... B66F 11/04

[52] U.S. Cl. ..... 182/2; 212/266

[58] Field of Search ..... 182/2; 212/266; 52/117

[56] References Cited

U.S. PATENT DOCUMENTS 3,127,952 4/1964 Baerg ..... 182/2

3,252,542 5/1966 Trump ..... 182/2

FOREIGN PATENT DOCUMENTS 1270341 7/1961 France ..... 182/2

*Primary Examiner*—Reinaldo P. Machado

*Attorney, Agent, or Firm*—Ferrill and Logan

[57] ABSTRACT

An improved boom elevating device for a line lift or other aerial lift is disclosed. The present invention vastly expands the range of movement of the line lift through use of an extension arm, attached between a line lift boom and conventional boom actuating means, and an extension arm activating means.

16 Claims, 4 Drawing Sheets

FIG. 5
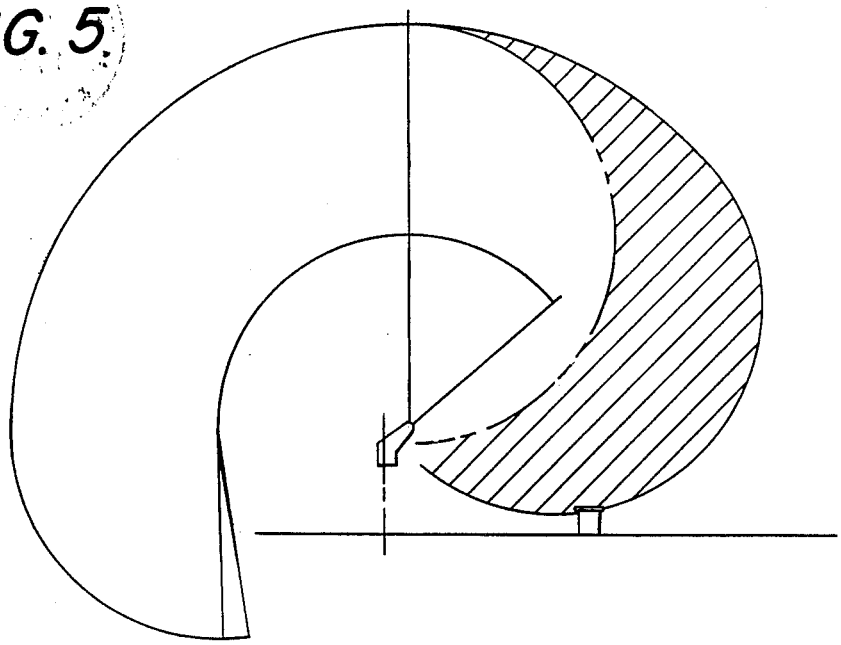
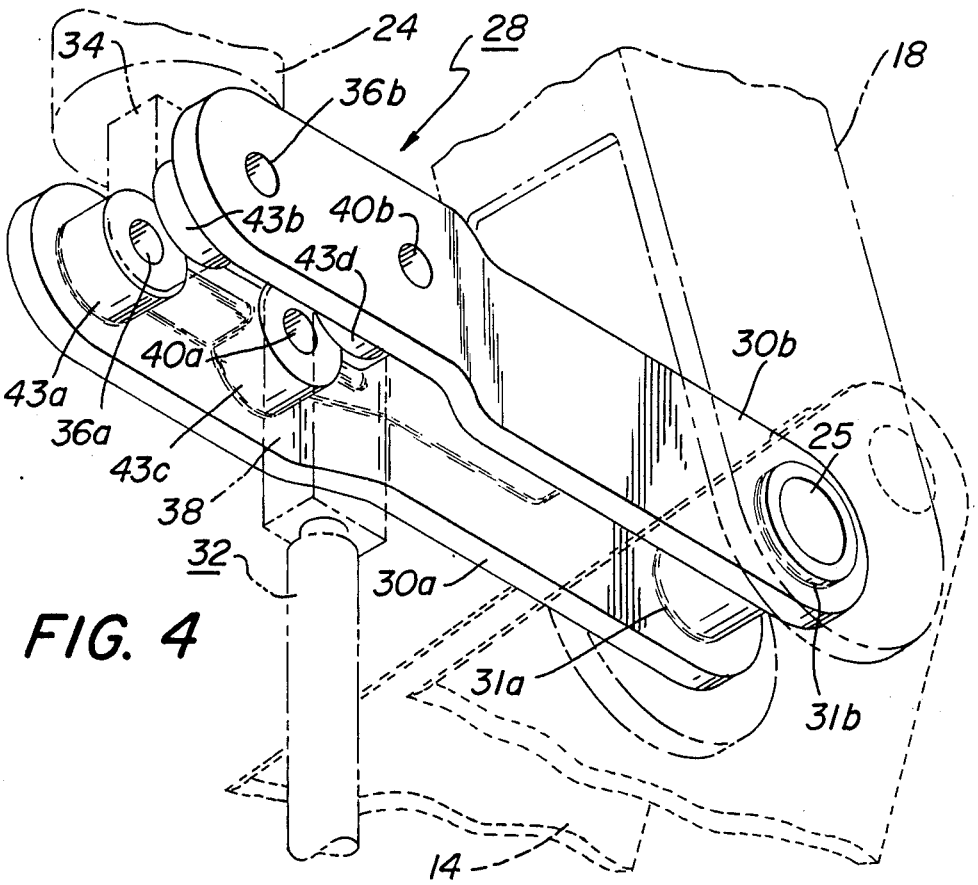
FIG. 4

BOOM ELEVATING DEVICE FOR LINE LIFTS

BACKGROUND OF THE INVENTION

1. Field of the Invention

The present invention relates to line lifts for such use as in servicing electrical and telephone lines and for maintaining right of ways for such lines. More particularly, the present invention relates to apparatus for extending the range of operation of such lifts.

2. Description of the Prior Art

A line lift is a device used for elevating an individual to a specific location above the ground surface, usually for maintenance purposes. For example, telephone repairmen who need to repair telephone wires strung from poles use line lifts mounted onto truck beds to reach those wires. Similarly, tree maintenance persons employ line lifts to elevate themselves to those areas of a tree requiring maintenance, such as trimming or dead branch removal.

A typical line lift incorporates a lower boom pivotally connected to a mast assembly at one end and an upper boom with a basket at a second end. A hydraulically operated expandable piston cylinder is connected to the lower boom. When the piston cylinder is expanded, it causes the lower boom to pivot upwardly in a direction away from the ground surface. The upper boom is extended by means of a hydraulically actuated pulley assembly attached to the lower boom, adjacent the upper boom. By extending the lower and upper booms, a person standing in the basket can be elevated to a specific location above the ground surface. One representative line lift of this construction is the Asplundh L-30 Series of line lifts manufactured by Asplundh Tree Expert Company.

Although such lifts operate extremely well, one problem some times associated with using such a line lift is that the boom has a limited range of rotation relative to the base of the mast assembly, usually less than 90 degrees. This limits the flexibility and degree of extension of the upper boom and basket. Thus, when an individual wishes to reach a specific location beyond the lift's normal range of extension, he must re-fold the booms, move the truck and then again unfold the booms, thereby expending additional time and effort in using the line lift.

Another problem associated with a line lifts' limited range of extension is that the vehicle on which the line lift is mounted must be parked on stable ground. Clearly the vehicle cannot be set up on soft ground or an excessive grade because this detracts from its stability and safety. However, often it is not possible to reach a specific location above the ground surface if the truck is parked on the spot where the ground is most stable and level. The operator is thus forced to forego maintainance or to secure his vehicle on less stable ground, thus exposing himself, the crew, and his vehicle to potentially hazardous consequences.

Finally, the situation may arise where the area requiring maintenance is inaccessible to a typical line lift having limited extension capabilities. If maintenance is to occur at all in these instances, a special aerial lift having elongated booms or less efficient maintenance means must be used.

Accordingly, it is a primary object of the present invention to provide a line lift having a greater range of flexibility and extension.

It is a further object of the present invention to provide such a lift with extended extension means which employs standard sized booms and adds minimal weight and complexity to existing lift equipment.

SUMMARY OF THE INVENTION

The present invention is directed to a line or aerial lift having both a greater range of extension and flexibility relative to a mast assembly, while reducing the amount of time and effort required in its set-up.

The improved boom elevating device of the present invention comprises a mast assembly having a lower boom pivotally connected at one end to the mast assembly; an extension arm pivotally connected at one end at the point where the lower boom and mast assembly are pivotally connected; a first expandable piston cylinder connected to the lower boom and a second end of the extension arm; a second expandable piston cylinder pivotally connected at one end to the mast assembly and at a second end to the extension arm for rotating the extension arm, lower boom and first piston cylinder.

This design greatly increases the range of extension of conventional line lift equipment without adding additional weight, size or complexity to the unit as a whole.

BRIEF DESCRIPTION OF THE DRAWINGS

The foregoing summary, as well as the following detailed description will be better understood when read in conjunction with the appended drawings. For the purpose of illustrating the invention, there is shown in the drawings an embodiment which is presently preferred, it being understood, however that this invention is not limited to the precise arrangement and instrumentalities shown.

FIG. 4 is an isometric view of the extension arms of the present invention, connecting the lower boom at one end and the first expandable piston cylinder at a second end, and the second expandable piston cylinder intermediate its ends.

FIG. 5 is a schematic representation of the range of extension of a conventional line lift compared with that of a line lift having the improved boom elevating device, wherein the added degree of extension is represented by the shaded area.

DETAILED DESCRIPTION OF THE INVENTION

Figure 1:
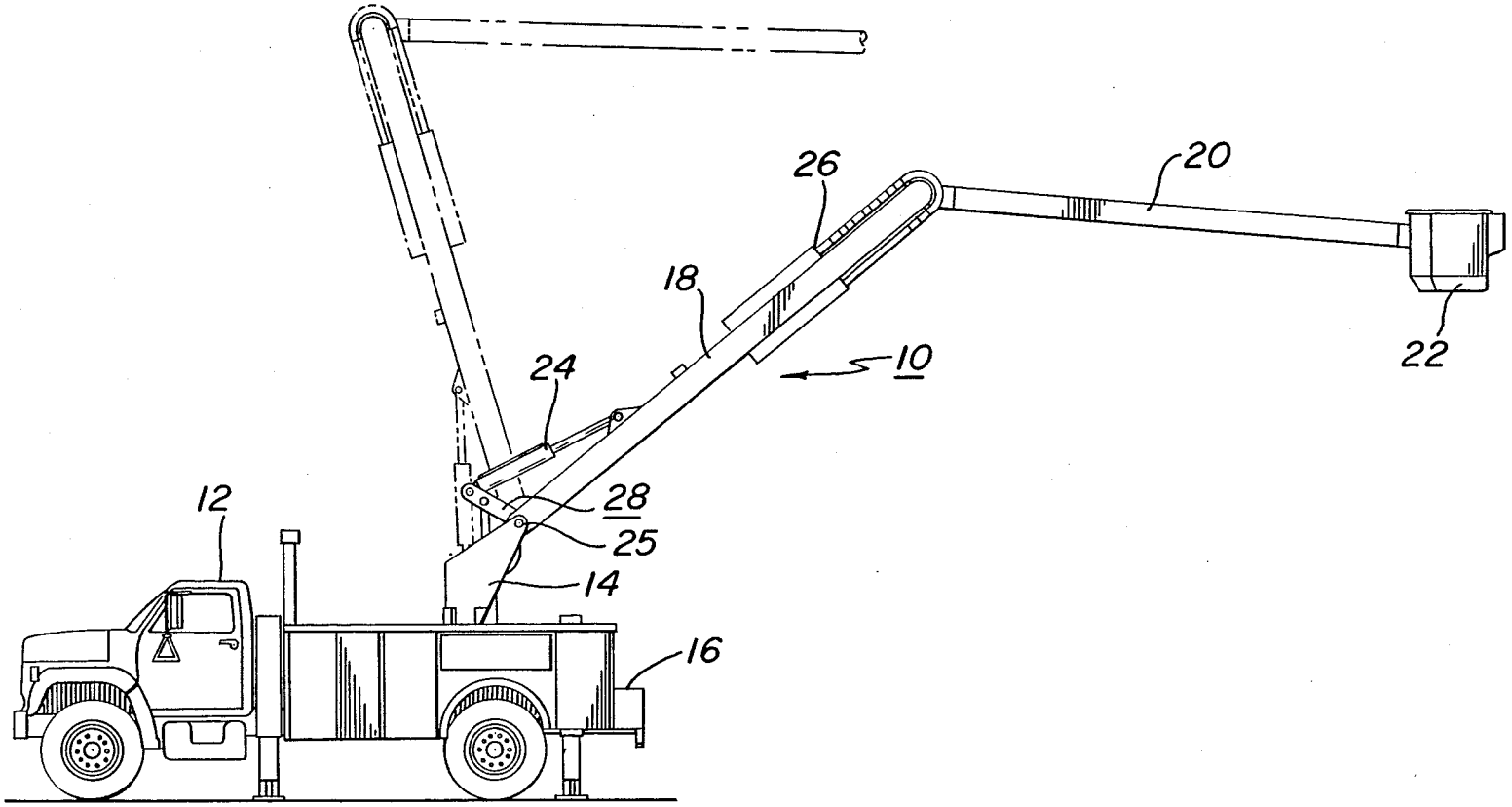
FIG. 1 is an elevation view of the preferred embodiment of an improved line lift according to the present invention anchored to the bed of a truck shown in a partially extended position in phantom lines and a fully extended position in solid lines.

The present invention provides an improved line lift with a greatly enhanced operable range. Shown in FIG. 1 is a line lift 10 attached to a conventional utility vehicle 12. Conventional line lifts 10 often comprise a pylon mast assembly 14 rotationally coupled to a vehicle bed 16, a lower boom 18, an upper boom 20, a basket 22, a hydraulic piston cylinder 24 for actuating rotation of the lower boom 18 relative to the mast assembly 14 around pivotal connection 25, and chain driven actuation means 26 to rotate the upper boom 20 relative to the lower boom 18.

As suggested in phantom in FIG. 1, the hydraulic cylinder 24 is generally anchored within the mast assembly 14, which necessarily limits the range of extension of the lower boom 18 to the effective reach of the cylinder 24. In the present invention the range of extension is greatly increased through the use of an enhanced boom elevating device 28.

Figure 3:
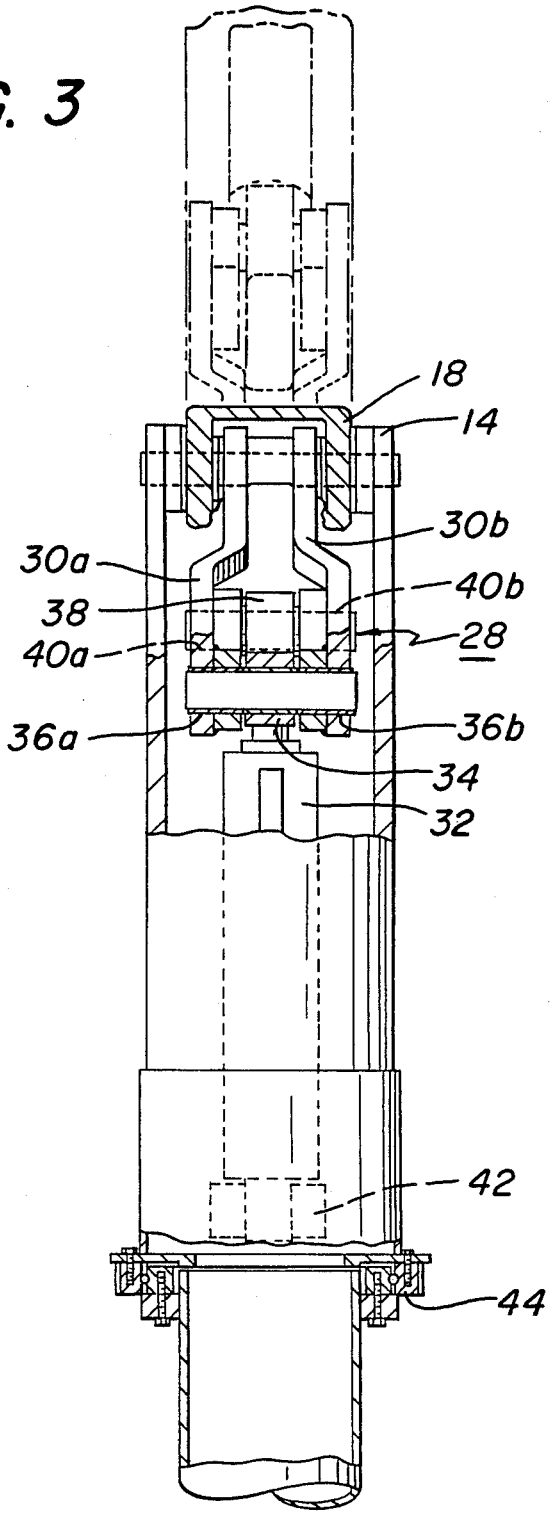
FIG. 3 is a sectional view of the present invention along line 3—3 of FIG. 2.

As is shown in FIGS. 3 and 4, the enhanced boom elevating device 28 of the present invention comprises a pair of substantially parallel extension arm elements 30*a* and 30*b*, and an expandable elevating means 32. Via openings 31*a* and 31*b*, the extension arms 30*a* and 30*b* pivotally mount within the pivotal connection 25 between lower boom 18 and mast assembly 14. At the opposite end, the extension arms 30*a* and 30*b* pivotally mount to the lower connection 34 of piston cylinder 24 via a pin (not shown) passing through openings 36*a* and 36*b* within extension arms 30*a* and 30*b*.

The upper connection 38 of expandable elevating means 32 attaches intermediate the ends of extension arms 30*a* and 30*b* via a pin (not shown) passing through openings 40*a* and 40*b* in extension arms 30*a* and 30*b*. The elevating means 32 may comprise any form of hydraulic piston cylinder, pneumatic piston cylinder, or other form of activatable extension means.

The unit shown is a model 5½ inch bore cylinder 20½ inch stroke hydraulic piston cylinder manufactured by Benton Harbor Engineering Works. It readily mounts within the mast assembly 14 via brackets 42.

The extension arms 30*a* and 30*b* may be constructed of any strong, rigid material, such as steel or steel alloy. Although the extension arms 30*a* and 30*b* may be constructed of multiple planer plates welded together to achieve the correct spacing between them, the preferred construction is shown in the drawings. This includes the contour shape shown and the addition of reinforcing bosses 43*a*, 43*b*, 43*c*, and 43*d*.

As is known, the mast assembly 14 itself may be provided with a rotational coupling at its base which permits full 360° movement of the mast assembly 14 relative to the vehicle 12. One such form of rotational connection, shown in FIGS. 3 and 4, comprises a bearing 44, a driven gear 46, surrounding the base of the mast assembly 14, a drive motor 48 and a drive gear 50 transmitting power between the drive motor 48 and the mast assembly 14. A mast assembly pylon 52 is provided to provide adequate anchorage.

Figure 2:
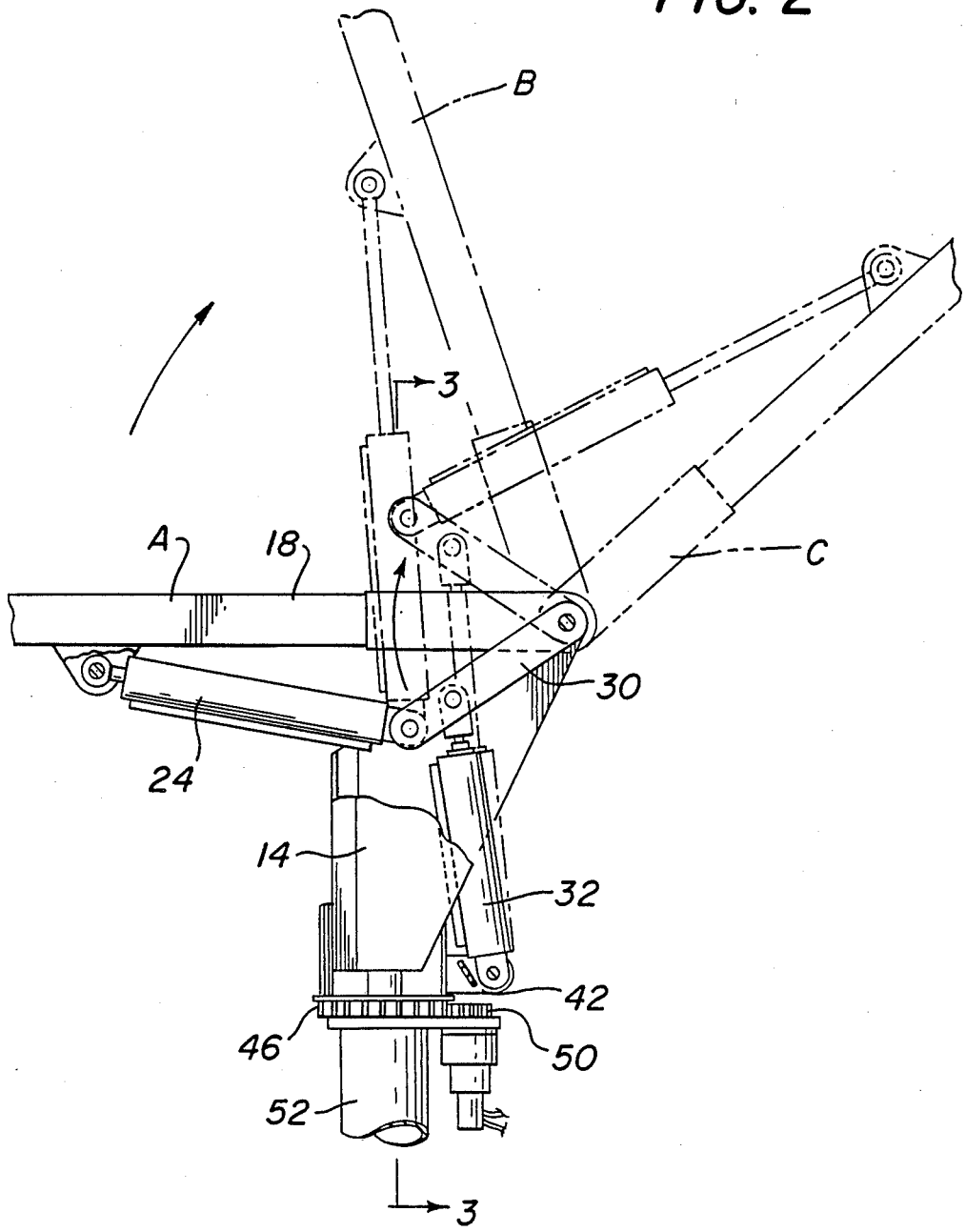
FIG. 2 is an elevation view, partially in crosssection, of the present invention shown in a retracted position in solid lines and partially and fully extended positions in phantom lines.

The range of operation of the present invention is shown in FIG. 2. When piston cylinder 24 and piston cylinder 32 are fully contracted, the lower boom 18 assumes its lowest mast position A. As cylinder 24 is expanded to full extension, the lower boom assumes position B. This essentially represents the greatest extent of rotation of the lower boom 18 attainable using conventional line lift equipment. Through actuation of cylinder 32, and its resulting rotation of extension arms 30, the range of extension of the lower boom is greatly extended to include up to position C.

The effect of this additional extension is shown schematically in FIG. 5. Through use of the enhanced boom elevating device 28 of the present invention, the range of extension of a conventional line lift within a single plane of movement (as represented by the unshaded area) is extended to include the previously unattainable range of movement shown in the shaded area.

The present invention vastly increases the range of extension of a conventional line lift while retaining nearly all conventional equipment and adding virtually no additional complexity or weight to the overall assembly.

While particular embodiments of the present invention are disclosed herein, it is not intended to limit the present invention to such disclosure, and changes and modifications may be incorporated and embodied within the scope of the following claims.

What is claimed is:

1. An improved boom elevating device for providing enhanced outward extension of a line lift, which comprises:

a mast assembly anchored to a vehicle bed;

a boom pivotally connected at one end to said mast assembly, said boom including a lower boom pivotally connected at a first end to said mast assembly and an upper boom connected to a second end of said lower boom;

at least one extension arm pivotally connected at one end at the point where said boom and mast assembly are pivotally connected;

a basket connected to the end of said upper boom;

a first expandable elevating means pivotally connected intermediate the ends of said boom at one end and the extension arm at its other end; and a second expandable elevating means pivotally connected at one end to said mast assembly and at a second end to said extension arm, said second expandable elevating means rotating said extension arm relative to its pivotal connection to said mast assembly;

wherein when said first expandable elevating means and said second expandable elevating means are fully extended said lower boom achieves an angle of rotation greater than 90 degrees relative to said vehicle bed so as to maximize the outward extension of said upper boom and basket.

2. An improved boom elevating device as recited in claim 1 wherein said first expandable elevating means comprises a hydraulic piston cylinder.

3. An improved boom elevating device as recited in claim 2 wherein said second expandable elevating means comprises a hydraulic piston cylinder.

4. An improved boom elevating device as in claim 1 further including means for rotating said mast assembly about a vertical central axis.

5. An improved boom elevating device as in claim 4 wherein said means for rotating said mast assembly comprises actuating means generating rotational forces, and means to transfer rotational forces from said actuating means to said mast assembly.

6. An improved boom elevating device as in claim 1 further including a second extension arm element operatively coupled to, and in synchronous operation with, said extension arm.

7. The improved boom elevating device as in claim 6 wherein said extension arm and said second extension arm are operated in parallel.

8. An improved boom elevating device for providing enhanced outward extension of a line lift comprising:

a mast assembly anchored to a vehicle bed and rotatably connected to a rotational means;

a lower boom pivotally connected at one end to said mast assembly;

a pair of substantially parallel extension arms operatively coupled and pivotally connected at one end to said mast assembly at the point where said mast assembly and said lower boom are pivotally connected;

a first piston cylinder means pivotally connected between said lower boom and a second end of said extension arms;

an upper boom connected at one end to a basket and connected at a second end to a second end of said lower boom; and a second piston cylinder means pivotally connected at one end to said mast assembly and at a second end to said extension arms, for rotating said extension arms, said booms and said first piston cylinder means around the pivotal connection to said mast assembly, that such that said lower boom achieves an angle of rotation greater than 90° relative to said vehicle bed thereby maximizing the outward reach of said upper boom and said basket.

9. In a boom elevating device for providing enhanced extension of a line lift of the type having a lower boom adjustably connected to an upper boom and basket, one end of the lower boom being pivotally connected to a mast assembly anchored to a vehicle bed, and means to actuate the lower boom to rotate relative to said mast assembly so as to maximize the outward reach of said upper boom and basket, the improvement comprising:

an extension arm pivotally connected at one end to the point where said lower boom is connected to said mast assembly;

said means to actuate the lower boom attached at one end to said lower boom and at another end to said extension arm; and expandable elevating means pivotally connected at one end to said mast assembly and at a second end to said extension arm for rotating the extension arm, the lower boom and the means to rotate the lower boom relative to said vehicle bed so as maximize the outward reach of said upper boom and basket.

10. A boom elevating device as in claim 9 wherein said expandable elevating means comprises a hydraulic piston cylinder.

11. A boom elevating device as in claim 9 wherein said means to actuate the lower boom comprises a hydraulic piston cylinder.

12. A boom elevating device as in claim 9 including a basket connected to said upper boom.

13. A boom elevating device as in claim 9 including a second extension arm operatively coupled to said extension arm.

14. A boom elevating device as in claim 13 wherein said extension arms are substantially parallel.

15. A boom elevating device as in claim 9 including means for rotating said mast assembly about a vertical central axis of rotation of said mast assembly.

16. A boom elevating device as in claim 15 wherein said means for rotating said mast assembly comprises a chain and sprocket assembly operatively coupling said mast assembly to means to generate rotational forces.

* * * * *